US005206558A

United States Patent [19]

Losonczi et al.

[11] Patent Number: 5,206,558

[45] Date of Patent: Apr. 27, 1993

[54] LIGHT SOURCE PROVIDED WITH LIGHT REFLECTING MEANS

[75] Inventors: Zoltán Losonczi; György Szabó, both of Budapest, Hungary

[73] Assignee: Tungsram Részvénytársaság, Budapest, Hungary

[21] Appl. No.: 691,327

[22] Filed: Apr. 29, 1991

[30] Foreign Application Priority Data

Apr. 28, 1990 [HU] Hungary ..... 2623/90

[51] Int. Cl.[5] ..... H01K 1/26; H01J 5/50

[52] U.S. Cl. ..... 313/113; 313/315; 313/318

[58] Field of Search ..... 313/25, 113, 318, 315

[56] References Cited

U.S. PATENT DOCUMENTS

| | | | |
|---|---|---|---|
| 4,219,870 | 8/1980 | Haraden et al. | 362/226 |
| 4,370,587 | 1/1983 | Notelteirs | 313/113 |
| 4,564,783 | 1/1986 | Kreig et al. | 313/113 |
| 4,843,276 | 6/1989 | Jacrot | 313/318 |
| 4,864,184 | 9/1989 | Fleming | 313/318 |
| 5,073,742 | 12/1991 | Busai et al. | 313/318 |

FOREIGN PATENT DOCUMENTS

| | | |
|---|---|---|
| 0075304 | 3/1983 | European Pat. Off. . |
| 0341633 | 11/1989 | European Pat. Off. . |
| 2176898 | 11/1973 | France . |
| 190574 | 12/1988 | Hungary . |

*Primary Examiner*—Donald J. Yusko
*Assistant Examiner*—Brian Zimmerman
*Attorney, Agent, or Firm*—Spencer, Frank & Schneider

[57] ABSTRACT

A light source includes a reflector, a lamp and a securing mechanism firmly fixing the lamp to the reflector. The reflector includes a reflecting portion and a central hollow neck portion having an inner surface. The lamp includes an envelope provided with a pinch-sealed portion; a light emitting component accommodated in the envelope; and current feedthroughs electrically connected to the light emitting components and passing through the pinch-sealed portion to project outwardly from the envelope. The securing mechanism includes a first metal sleeve tightly surrounding the pinch-sealed portion of the envelope; a second metal sleeve lining the inner surface of the neck portion of the reflector and surrounding the first metal sleeve; and clamping components affixed to the second sleeve. The clamping components fit into the hollow neck portion and encase the inner surface thereof from two opposite sides. The first and second metal sleeves are fixedly secured to one another.

3 Claims, 2 Drawing Sheets

LIGHT SOURCE PROVIDED WITH LIGHT REFLECTING MEANS

BACKGROUND OF THE INVENTION

The present invention relates to a light source provided with light reflecting means.

In the light source industry, there are known incandescent and discharge light sources provided with light reflecting means, which is to be firmly integrated with an incandescent or discharge lamp. During this integration, the light emitting component—e.g. the incandescent filament in the case of incandescent lamps—is to be in most cases positioned in or adjacent to the focal plane of the light reflecting surface. Having made this optical adjustment of the relative position of lamp to light reflecting means, this position is to be fixed. To achieve this, a heat-resistant adhesive, e.g. cement is mostly used, but mechanical means are also known. In this connection, the method according to published EP application No. 341 633 is referred to.

The fixation ensured by cementing is less suitable for mass-production since the cement has a heat insulating property making it unable to conduct the heat generated due to the operation of the lamp and because the cementing requires a long time as the cement will not harden instantaneously. The time period during which the cement hardens increases production times and also increases the risk of a change in the relative position of the light reflecting means to the lamp. This latter consequence should not be tolerated since it is a fundamental requirement for light sources provided with light reflecting means to have a controlled light reflection that can only be assured if the light emitting component of the lamp—e.g. the filament in the case of incandescent lamps—is positioned in the focus of the reflecting surface of the light reflecting means.

Solutions for fixing by mechanical means are described in HU-B 190.574 and U.S. Pat. No. 4,370,587. These arrangements can be used exclusively for light reflecting means made from metal.

SUMMARY OF THE INVENTION

An object of the invention is therefore to provide a light source integral with light reflecting means, which can be manufactured in a time-saving manner, the optical adjustment of which can be easily accomplished and the adjusted position of which is reliably maintained.

A further object of the invention is to provide a way of firmly fixing a lamp and any type of light reflecting means, made from plastic or glass in addition to metal, to each other using a mechanical means and also making possible a mass manufacture of the light source provided with light reflecting means.

Accordingly, the new light source provided with light reflecting means, according to the invention comprises a light reflecting means and a lamp, primarily a halogen incandescent lamp, fitted into the central neck portion of the light reflecting means and containing a light emitting component in a prescribed position relative to the light reflecting means. The envelope of the lamp has a pinch-sealed end portion having current feedthroughs passing therethrough and a first metal sleeve fixed to it. According to the invention the central neck portion of the light reflecting means is lined with a second metal sleeve receiving the first metal sleeve and the second metal sleeve is provided with components for clamping it to the light reflecting means. The second and first metal sleeves are joined to each other, preferably by welding. In addition, the portions of the current feedthrough inside the first metal sleeve are surrounded by an electrical insulator.

According to a preferred embodiment, the components clamping the second metal sleeve to the light reflecting means are limiter tab(s) protruding or bent out from the wall of the second metal sleeve and a metal plate surrounding the second metal sleeve and joined, preferably by welding, with the second metal sleeve. The metal plate is supported on the outer edge of the neck portion of the light reflecting means. ("Outer" is the intended to mean a position more remote from the lamp.) The electrical insulator is preferably a ceramic rod provided with bores to receive the feedthroughs and is partly pushed into the first metal sleeve.

DESCRIPTION OF THE PREFERRED EMBODIMENT

Figure 1:
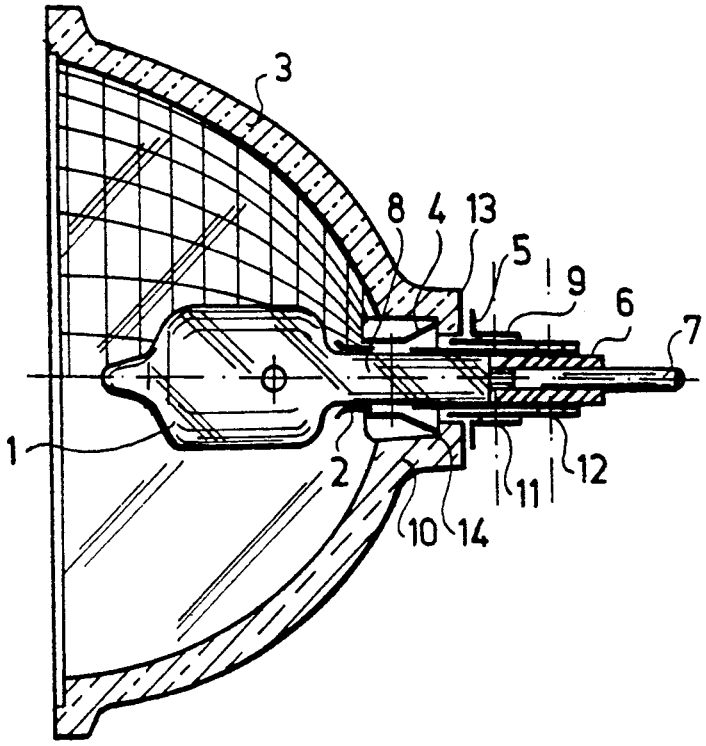
FIG. 1 is a sectional view of an embodiment of the invention along the axis of the light source.
Figure 2:
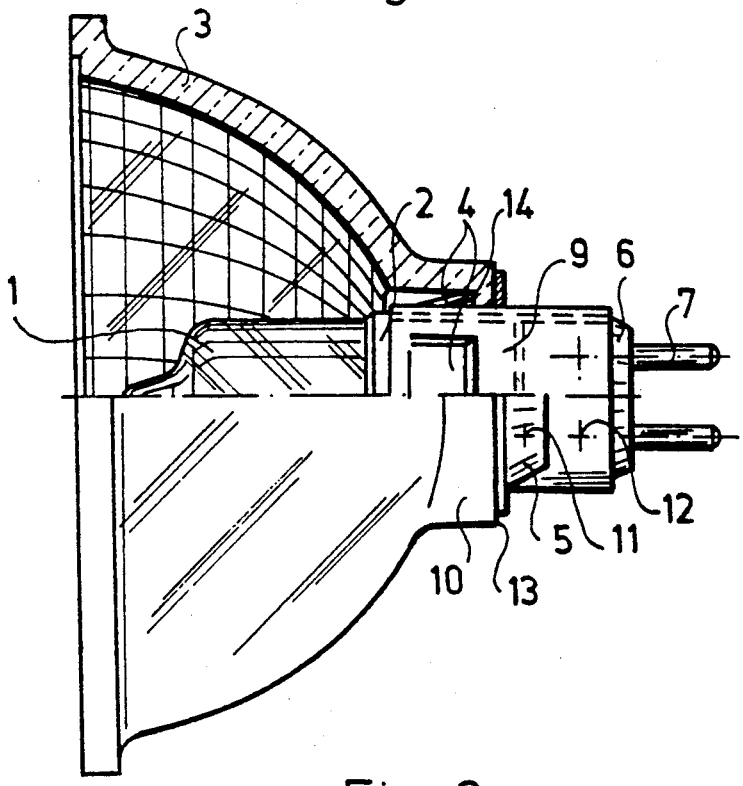
FIG. 2 is a partially sectional view along the axis of the light source, the section being taken perpendicularly to the sectional plane of FIG. 1.

In FIGS. 1 and 2 a 23 V,20 W halogen incandescent lamp 1 provided with light reflecting means 3 is shown. The envelope of the lamp 1 is made from Vycor or hard glass and ends in a pinch-sealed portion 8, from which current feedthroughs 7, made usually from molybdenum protrude. The pinch-sealed portion 8 is tightly surrounded by a first metal sleeve 2 and the current feedthroughs 7 are, inside the first metal sleeve 2, surrounded by an electrical insulator 6. The neck portion 10 of the light reflecting means 3 is lined with a second metal sleeve 9 having bent-out tabs 4 abutting the inner edge of the neck portion 10 ("inner" is intended to mean a position closer to the lamp.) This second metal sleeve 9 is joined by welding with a metal plate 5 supported on the outer edge 13 of the neck portion 10 of the light reflecting means 3. In case the edges 13 and 14 of the neck portion 10 of the light reflecting means 3 are, due to its processing, parallel to each other, the position of the filament height is determined.

The so-called optical adjustment of the light source provided with light reflecting means can be carried out in two ways depending on whether the relative position of the light emitting component of the lamp 1 to the light reflecting surface of the light reflecting means 3 is adjusted earlier by forcing the first metal sleeve 2 on the pinch-sealed portion 8 or later, when mounting the lamp 1 in the light reflecting means 3.

When the first method is used, filament position is kept within close tolerance limits by fixing the first metal sleeve 2 to the pinch-sealed portion 8. Close tolerance limits means that for filament height and angle, tolerance ranges of ±0,10 mm and ±30 minutes are permissible, respectively. If it is impossible to ensure that the above close tolerance limits relative to the basis formed during the processing are observed as early as in base-fitting of the lamp 1, i.e. when the first metal sleeve 2 is fitted to the pinch-sealed portion 8, then it is this optical adjustment that must be carried out prior to joining the light reflecting means 3 and the lamp 1.

Joining of the light reflecting means 3 and the lamp 1 should be finalized only after the optical adjustment is completed. Joining is preferably carried out by bonding the first metal sleeve 2 and the second metal sleeve 9 together by a weld 12, but, of course, any different method, e.g. soldering is also conceivable. The second metal sleeve 9 is composed of two parts which are preferably joined by a weld 11. The welding operation has the advantages of compatibility with the manufacturing process, of producing a reliable joint and of requiring a relatively short completion time.

Figures 3, 3A, 3B:
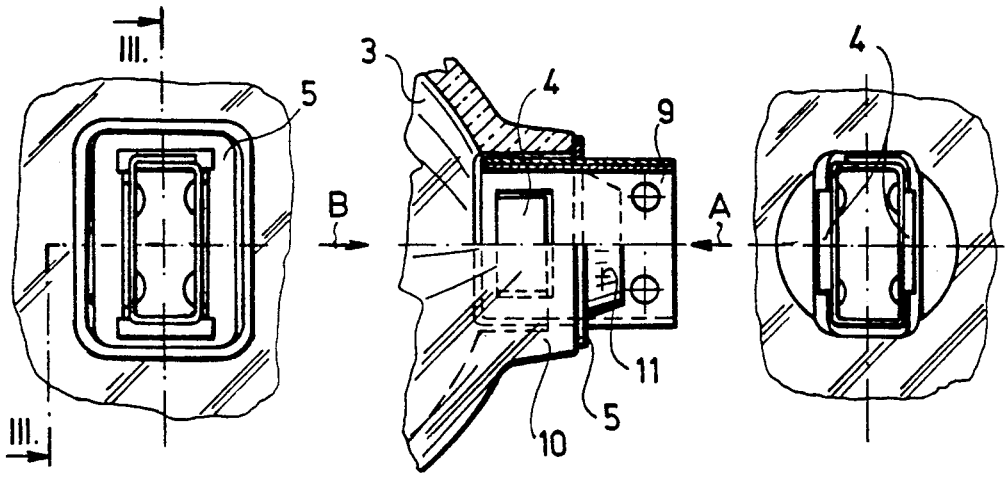
FIG. 3 is a sectional view, taken along line III—III of FIG. 3*a*, of the second metal sleeve fixed to the light reflecting means as used in an embodiment of the light source provided with light reflecting means.
FIG. 3*a* is an end view as seen in the direction of arrow A in FIG. 3.
FIG. 3*b* is an end view as seen in the direction of arrow B in FIG. 3.

In FIGS. 3 3*a* and 3*b*, the second metal sleeve 9 fitted to the light reflecting means 3 is seen in more details since the lamp 1 is omitted for clarity.

Figures 4, 4A:
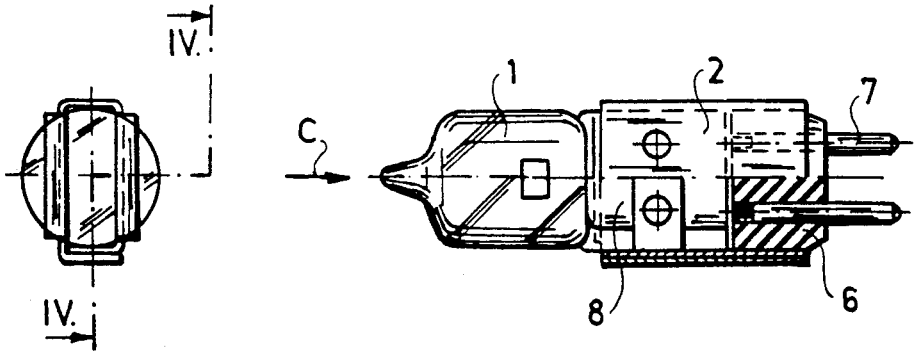
FIG. 4 is a side elevational view, partly in section along line IV—IV of FIG. 4*a*, of the lamp with the first metal sleeve fixed thereto
FIG. 4*a* is an end view as seen in the direction of arrow C in FIG. 4.

In FIGS. 4 and 4*a*, incandescent lamp 1 provided with the first metal sleeve 2 is shown. This lamp 1 is to be fitted into the light reflecting means 3 provided with the second metal sleeve 9, as shown for example, in FIG. 3. After fitting and, if needed, after performing the optical adjustment, the first metal sleeve is joined, preferably by welding, to the second metal sleeve 9 as seen in FIGS. 1 and 2.

The most important advantage of the construction according to the invention compared to the conventional solutions is that it makes the use of the cement unnecessary for the operation of joining the lamp with the light reflecting means. The mechanical joining is simple and it ensures a precises fit with close tolerance limits. In addition, by making use of a mechanical joining, there is a freedom of choice as to the material for the light reflecting means. The construction according to the invention enables to join the light reflecting means made from any known appropriate material with the lamp. The construction is especially preferable in the case of light reflecting means made from plastic.

We claim:

1. A light source comprising (a) a reflector including a reflecting portion and a central hollow neck portion having an inner surface;

(b) a lamp having (1) an envelope provided with a pinch-sealed portion;

(2) a light emitting component accommodated in said envelope; and (3) current feedthroughs electrically connected to said light emitting components and passing through said pinch-sealed portion to project outwardly from said envelope; and (c) securing means for firmly fixing said lamp to said reflector whereby said lamp and said reflector form an integral unit; said securing means comprising (1) a first metal sleeve tightly surrounding said pinch-sealed portion of said envelope;

(2) a second metal sleeve lining said inner surface of said neck portion of said reflector and surrounding said first metal sleeve;

(3) clamping components affixed to said second sleeve; said clamping components fitting into said hollow neck portion and encasing said inner surface thereof from two opposite sides; said clamping components comprising (i) tabs carried on and projecting outwardly from said second metal sleeve and engaging said inner surface; and (ii) a metal plate surrounding said second metal sleeve and being joined thereto; said metal plate being in engagement with an outer edge of said hollow neck portion; and (4) connecting means for fixedly securing said first metal sleeve to said second metal sleeve.

2. The light source as defined in claim 1, further comprising an electric insulator rod accommodated in said first metal sleeve; the insulator rod having two longitudinal, parallel-spaced bores, each accommodating a separate one of said current feedthroughs.

3. The light source as defined in claim 1, wherein said connecting means comprises a weld.

* * * * *